US005806928A

United States Patent [19]

Gattuso et al.

[11] Patent Number: 5,806,928

[45] Date of Patent: Sep. 15, 1998

[54] INFLATABLE AIR CELL HAVING IMPROVED CELL-TO-AIR TUBE CONNECTION

[75] Inventors: David A. Gattuso, Deerfield; Richard D. Rhodes, Jr., Somersworth, both of N.H.

[73] Assignee: McCord Winn Textron Inc., Manchester, N.H.

[21] Appl. No.: 892,477

[22] Filed: Jul. 14, 1997

[51] Int. Cl.[6] ..... A47C 3/025

[52] U.S. Cl. ..... 297/284.6; 297/452.41

[58] Field of Search ..... 297/DIG. 3, 452.41, 297/284.6, 199, 200; 5/655.3, 654, 671, 706, 655.5; 156/145, 289, 290, 292

[56] References Cited

U.S. PATENT DOCUMENTS

| | | |
|---|---|---|
| Re. 17,057 | 7/1928 | Voit . |
| 1,886,637 | 11/1932 | Buckley . |
| 3,249,479 | 5/1966 | Boicey . |
| 3,326,601 | 6/1967 | Vanderbilt et al. . |
| 3,872,525 | 3/1975 | Lea et al. . |
| 4,965,899 | 10/1990 | Sekido et al. . |
| 5,002,336 | 3/1991 | Feher . |
| 5,082,326 | 1/1992 | Sekido et al. . |
| 5,263,211 | 11/1993 | Grant . |
| 5,280,997 | 1/1994 | Andres et al. . |
| 5,444,881 | 8/1995 | Landi et al. . |
| 5,669,092 | 9/1997 | Lin . |

*Primary Examiner*—Milton Nelson, Jr.
*Attorney, Agent, or Firm*—Reising, Ethington, Learman & McCulloch PLLC

[57] ABSTRACT

An air cell system for vehicle seat and mattress applications includes an air cell constructed from facing sheets of flexible air-impermeable material that are sealed along their marginal edges. A gap is provided at a prescribed location along the seam to accommodate and air tube. The portion of the air tube received in the gap has a generally diamond shaped cross section including a central tubular region and opposed lateral side sections that taper radially outwardly in order to occupy correspondingly shaped regions of the gap. The shaped end of the air tube is sealed to the facing cell layer material to provide an airtight, unstressed seal therebetween.

6 Claims, 1 Drawing Sheet

INFLATABLE AIR CELL HAVING IMPROVED CELL-TO-AIR TUBE CONNECTION

This invention relates generally to inflatable air cell systems for vehicle seating and mattress applications and, more particularly, to the sealed connection between the air cell and an air tube installed to provide an opening into the interior of the air cell for introducing and exhausting air therefrom.

BACKGROUND OF THE INVENTION

Air cells, particularly for vehicle seating and mattress applications, are frequently constructed from facing layers of a flexible, air-impermeable material such as plastics film materials, that are heat sealed or otherwise joined about their marginal edges to enclose an interior inflatable air chamber. An air tube is sealed in place between the adjoining layers and is coupled to an airflow control system for inflation and deflation of the air cell.

Traditionally, the air tube is in the form of a short length of cylindrical plastic tubing that, when introduced between the layers of the cell, results in a somewhat diamond-shaped gap being formed between the layers having an enlarged mid region where the tube is located and two small tapering triangular regions to either side of the tube.

The mismatch in shape between the tube and gap presents inherent difficulties in producing an air-tight seal between the cell and tube. According to present practice, the cell layers in the vicinity of the triangular side regions are stretched into conformance about the cylindrical shape of the tube and joined to one another and to the tube by means of a heat seal, adhesives, etc. U.S. Pat. No. 4,965,899 discloses the typical air-to-cell seam connection, specifically with regard to the embodiments of FIGS. 65–67. The tooling and steps that are required to assure that a perfect air-tight seal is made between the flat sheets and cylindrical tubing contributes to the cost and difficulties in manufacturing leak-proof air cells. Another inherent objection to the traditional cell-to-tube connection is that it introduces constant stress of the cell material in the triangular regions tending to pull the seal apart in the vicinity of the tube.

The present invention is directed to the cell-to-tube connection of an air cell system made in such way as to overcome or greatly minimize the foregoing objections associated with traditional cell/tube connections.

SUMMARY OF THE INVENTION

An air cell system according to the invention for vehicle seating and mattress applications includes an air cell constructed from facing sheets of flexible, air-impermeable cell material sealed along their adjoining marginal edges. An air tube connector is installed between the layers at a prescribed location to provide airflow communication into and out of the interior of the air cell. The air tube is formed with a cross section that conforms substantially in shape to that of the gap formed between the facing sheet layers when in an unstressed state. The shape of the air tube includes a central tubular body portion and integrally formed side flange portions projecting laterally outwardly of the body portion from laterally opposite sides thereof. The added side flange portions occupy the triangular side regions of the gap mentioned above that result when the air tube is introduced between the layers.

The shaped air tube advantageously simplifies and improves that integrity of the seal connection between the cell and air tube. Since the tube conforms in shape to that of the gap between the cell layers in which it is installed, the layers may be sealed about the air tube in their unstressed state, thus eliminating the manufacturing step of stretching the sheets into conformance with a cylindrical air tube and avoiding the inherent separation forces introduced into the seal connection be reason of stretching the sheets.

THE DRAWINGS

A presently preferred embodiment of the invention is disclosed in the following description, and in the accompanying drawings, wherein.

DETAILED DESCRIPTION

Figure 1:
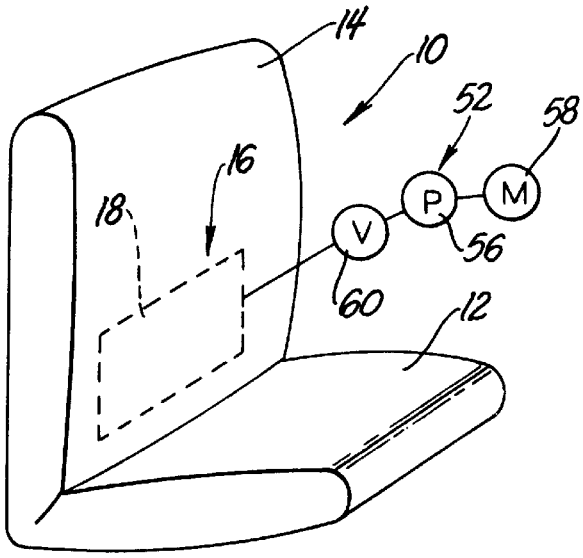
FIG. 1 is a perspective view of a vehicle seat embodying the air cell system of the invention.

Referring now more particularly to the drawings, there is shown in FIG. 1 a vehicle seat 10 having a generally horizontal seat rest portion 12 and an upright back rest portion 14 that is coupled to and projects upwardly from the seat rest portion 12 in conventional manner to support an occupant in a seated position on the seat 10.

The seat 10 is provided with an inflatable air cell system according to the invention which includes an inflatable air cell 18 that is mounted at a preselected location within the seat 10, preferably the lower back or lumbar region of the backrest 14.

The air cell 18 is constructed from two sheets or layers 20, 22 of flexible, air-impermeable air cell material, such as plastics, fabrics, or any other of the materials commonly used to construct inflatable air cells. The sheets 20, 22 are arranged in facing relation to one another and are joined together along their marginal edges 24, 26 in the usual way such as heat sealing, adhesives, etc. to enclose a sealed expandable space or air chamber 28 within the air cell 18.

Figure 2:
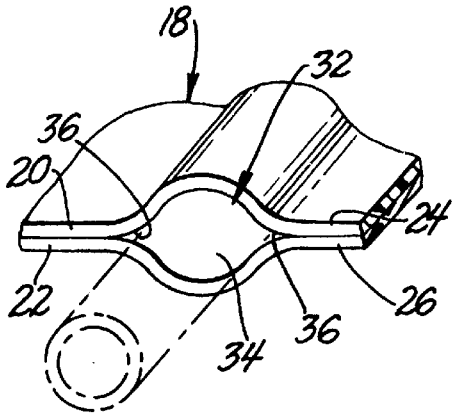
FIG. 2 is an enlarged fragmentary perspective view of an air cell having a gap at its seam resulting from the placement of an air tube between the facing sheets of the cell.

As illustrated in FIG. 2, a region of the cell edges 24, 26 is left initially unsealed to accommodate the insertion of an air tube connector 30 between the enjoined edge regions which, as illustrated, separates the edges 24, 26 defining a gap 32 that is oblong and generally diamond shaped having a central enlarged region 34 of the gap 32 and a pair of tapering side regions 36 extending from either side of the central region 34 and terminating at points 38 where the edges 24, 26 are sealed to one another on opposite sides of the gap 32. The cell layers 20, 22 are generally unstressed, particularly in the side regions 36 when the gap 32 is permitted to take on such a shape.

Figure 3:
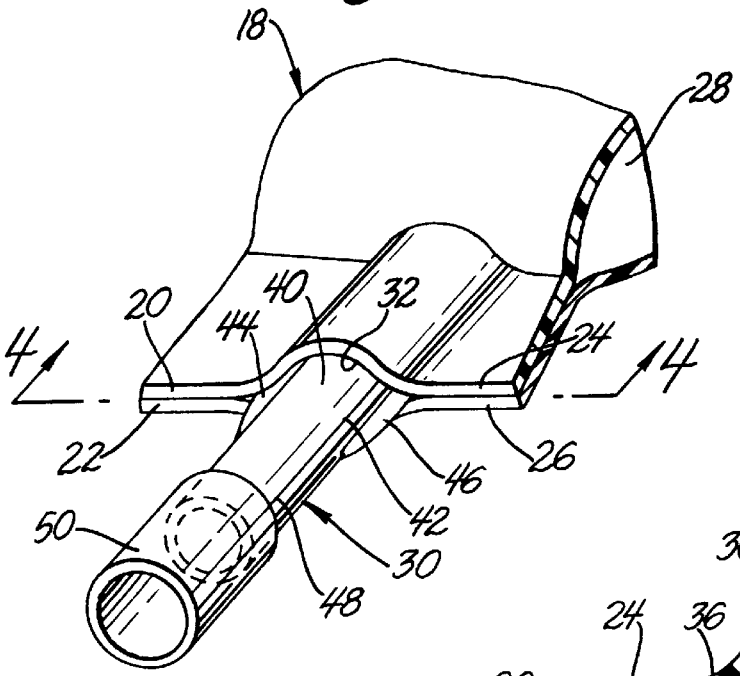
FIG. 3 is a view like FIG. 2 but showing an air tube of the invention installed in the gap.
Figure 4:
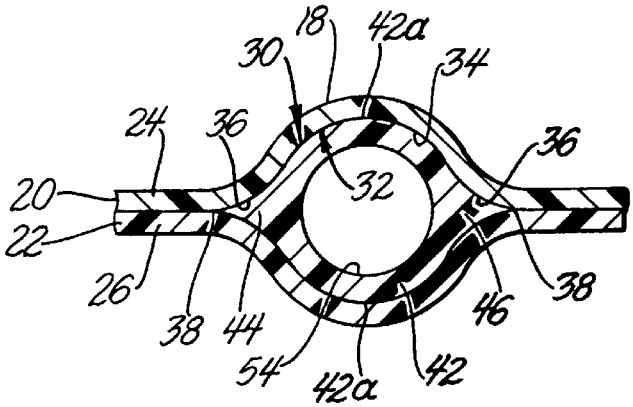
FIG. 4 is a transverse cross-sectional view taken along line 4—4 of FIG. 3.

According to the invention, as illustrated in FIGS. 3 and 4, the air tube connector 30 is constructed to have a cross-section, at least at its mounting end 40, that corresponds in shape substantially to that of the gap 32. As shown best in FIG. 4, the connector 30 has a central tubular portion that occupies the central region 34 of the gap 32. A pair of tapered side flange portions 44, 46 are formed integrally with the central tubular portion 42 and project in radially opposite directions therefrom to occupy the correspondingly tapered side regions 36 of the gap 32. In this way, the edges 24, 26 of the cell layers 20, 22 conform in the gap region substantially to the shape of the air tube 30 so as to provide full surface-to-surface contact between the cell layers 20, 22 and the air tube 30 while the layers 20, 22 are substantially in an unstressed state. The confronting surfaces of the cell layer edges 24, 26 and the air tube 30 are joined in a manner to provide an air-tight seal therebetween, by means such as heat sealing, RF sealing, vibration sealing, or adhesives.

The tube 30 extends outwardly from the air cell 18 to a free connecting end 48 which may have the usual cylindrical shape for connection with an air line 50 of an air flow control system 52. The air tube connector 30 is molded preferably as a single unitary piece from a material that is compatible with the air cell material to facilitate their sealed connection.

The invention contemplates that the connector 30 could be integrated with the air line such that rather than a separate connector, the free end of the air line 50 would be formed with the shaped mounting end 40 described above with respect to the connector 30.

The connector 30 has a central passage or opening 54 that is cylindrical in shape and provides air flow communication between the interior of the air cell 18 and the air flow control system 52. As illustrated in FIG. 1, the air line 50 is connected to an air pump 56 which in turn is driven by a motor 58 to deliver air under low pressure through the air line 50 and into the interior of the cell 18 in order to inflate the air cell 18, thereby adjusting the contour and thus the support that the seat 10 provides to its occupant. A relief valve 60 is installed in line and operates to selectively relieve the air cell of air pressure, bleeding it to atmosphere or directing it back through the air pump 56, depending on the particular valve/pump arrangement employed. Typical of such valves 60 are Shroeder-type valves, solenoid valves, etc.

The cell-to-tube connection described above is equally applicable to air mattress applications, wherein the cell layers 20, 22 described above define an inflatable bladder of the mattress and the shaped air tube 30 provides access to the interior of the air cell, allowing it to be inflated and deflated in the normal manner.

While a particular shape of the mounting end 40 of the air tube connector 30 has been illustrated in the drawings, those skilled in the art will appreciated that other gap configurations of the same general diamond shape are possible and will depend to a large degree on the characteristics of the cell layer materials 20, 22. By way of example, a thin and highly flexible cell layer material would likely produce smaller side regions 36 of the gap 32 when a connector is inserted between the layers. In contrast, cell layers fabricated of a relatively thicker and perhaps less flexible material would likely produce relatively larger side regions 36 when in its unstressed state. The invention contemplates that the particular shape of the mounting end 40 will be governed by the natural, unstressed shaped of the gap 32 and thus may differ in specific shape from application to application, but nonetheless will have the same general diamond shape as that of the gap.

The disclosed embodiment is representative of a presently preferred form of the invention, but is intended to be illustrative rather than definitive thereof. The invention is defined in the claims.

I claim:

1. An inflatable air cell system for vehicle seating and mattress applications comprising:

an air cell fabricated from two sheets of flexible cell material sealed together along marginal edges thereof to include a gap having an enlarged region and a pair of tapered side regions; and an air tube extending through said gap between said sheets into said air cell to provide an opening into said cell, said air tube having a cross-sectional profile including a tubular central body portion directly engaging said marginal edges at said enlarged region of said gap and said cross-sectional profile further including integrally formed side flange portions projecting radially outwardly of said central body portion from laterally opposite sides thereof and directly contacting said pair of tapered side regions for occupying said gap formed between said sheets as a result of positioning said air tube between said sheets, said sheets being sealed to said central body and flange portions of said air tube to provide an air tight connection therebetween.

2. The system of claim 1 wherein said air tube comprises a one piece molded plastics member.

3. The system of claim 1 wherein said body portion of said air tube is generally cylindrical in cross section and said flange portions comprise outwardly tapered projections extending in diametrically opposed relation from said body portion.

4. The system of claim 1 wherein said flange portions provide substantially full surface-to-surface contact with said sheets.

5. In a vehicle seat system having seat and back rest portions and an inflatable air cell operatively mounted within at least one of said seat portions and constructed from two sheets of flexible air-impermeable cell material sealed along adjoining marginal edges of said sheets to include a gap having an enlarged region and a pair of tapered side regions, and an air tube connector extending through said gap formed between said edges of said sheets to provide an opening into said air cell for connection with an air flow control device to control the flow of air into and out of said air cell, said connector being formed with a cross section that tapers laterally to either side of said connector and directly engaging said marginal edges at said enlarged region of said gap and said cross section further conforming substantially to an unstressed shape of said gap to provide full surface-to-surface sealing between said sheets and said connector.

6. A method of making an inflatable air cell system for vehicle seating and mattress applications comprising the steps of:

sealing two overlapping sheets of flexible air-impermeable air cell material along their marginal edges to define an air cell;

providing a gap in the sheets at the marginal edges thereof for access to the interior of the air cell;

providing an air tube connector having an integral tubular body portion and integral opposed radially tapering side flange portions; and interposing the connector in the gap between the edges of the sheets by directly contacting and enveloping the tubular body portion and opposed radially tapering side flange portions with the sheets at the gap therein and sealing the enveloping edges of the sheets to the connector to provide an air-tight connection therebetween.

* * * * *